US006145434A

United States Patent [19]

Tanaka et al.

[11] Patent Number: 6,145,434

[45] Date of Patent: Nov. 14, 2000

[54] STENCIL PRINTING METHOD AND DEVICE

[75] Inventors: Tetsuo Tanaka, Shizuoka; Kazuyoshi Kobayashi, Miyagi, both of Japan

[73] Assignees: Ricoh Company, Ltd., Tokyo; Tohoku Ricoh Co., Ltd., Miyagi-ken, both of Japan

[21] Appl. No.: 09/272,104

[22] Filed: Mar. 19, 1999

[30] Foreign Application Priority Data

Mar. 20, 1998 [JP] Japan ..... 10-092297
Jul. 9, 1998 [JP] Japan ..... 10-194479

[51] Int. Cl.[7] ..... B41M 1/12

[52] U.S. Cl. ..... 101/129; 101/123

[58] Field of Search ..... 101/114, 115, 101/116, 118, 119, 120, 121, 122, 123, 126, 127, 127.1, 129, 128.21

[56] References Cited

U.S. PATENT DOCUMENTS

| | | | |
|---|---|---|---|
| 2,019,375 | 10/1935 | Wheelwright | 101/115 |
| 3,081,698 | 3/1963 | Childress et al. | 101/129 |
| 3,487,775 | 1/1970 | Chaney et al. | 101/114 |
| 3,772,054 | 11/1973 | Anselrode | 117/38 |
| 4,729,305 | 3/1988 | Spencer | 101/35 |
| 5,048,416 | 9/1991 | Iijima | 101/118 |
| 5,553,539 | 9/1996 | Hasegawa | 101/128.21 |

*Primary Examiner*—Ren Yan
*Attorney, Agent, or Firm*—Cooper & Dunham LLP

[57] ABSTRACT

Provided are a stencil printing method and an apparatus therefor, in which a master having a low stiffness such as a single film may be transferred, in which a complicated mechanism for fitting and removing a plate is not needed and in which a degree of avoiding movement of a pressing roller to be in contact with the master can be minimized. The printing method and apparatus are characterized in that a perforated thermoplastic resin film is fed from a feeding roller and is brought into contact with an ink permeable sheet mounted under a tension for constituting a printing surface, in that a printing paper is superposed on the film, in that an ink roller having a printing ink from an inking section disposed on a surface of the ink permeable sheet opposite the film is displaced relative to the ink permeable sheet and the film while being maintained in rolling contact with the ink permeable sheet, thereby to perform the printing, and in that the ink permeable sheet, the film and the inking section are thereafter returned to their print starting state.

14 Claims, 15 Drawing Sheets

STENCIL PRINTING METHOD AND DEVICE

BACKGROUND OF THE INVENTION

This invention relates to a stencil printing method and to an apparatus therefor.

FIG. 18 is a schematic illustration of an outline of a conventional stencil printing device in which a plating section and a printing section are accommodated in a single apparatus. In FIG. 18, designated as 70 is a stencil master, 71 a master feeding section having a roll of the stencil master before perforation, 72 a plating section having a platen roller 72*a* and a thermal head 72*b*, 73 a cutter mechanism for cutting a perforated stencil master 70, 74 a transferring mechanism for the stencil master, 75 a printing section, 76 a plate cylinder, 76*a* a peripheral surface, 77 a plate discharging section and 78 is a printing paper. With this device, a stencil master 70 fed from the master feeding section 71 is thermally perforated in the plating section. The perforated stencil master 70 is transferred by the transferring mechanism 74 to the plate cylinder of the printing section and is cut by the cutter mechanism 73 into a sheet of the stencil master. This is then wound around the outer peripheral surface 76*a* of the plate cylinder 76. The printing paper 78 is fed to the printing section 75 and is printed there. After printing, the master used is discharged to the plate discharging section 77.

As shown in FIG. 18, however, the stencil printing master (master paper) has been hitherto cut each time the master is prepared. Therefore, when the cut stencil master is thin, problems are caused because of difficulty in transferring within the apparatus, in mounting to the plate cylinder and in discharging the master (namely in handling of the thin master).

To overcome the drawbacks, JP-A-H2-73987 proposes a stencil master printing device in which a master feeding and discharging section for a stencil master and a plating section are provided on a periphery of a plate cylinder and in which the stencil master is subjected, without being cut, to plating, mounting, printing and discharging operations as an elongated state. FIG. 19 is a side sectional view showing the stencil printing device. The device has a plate cylinder 80*d* attached to a rotary side plate 80*c* of a plate cylinder unit 80. A plate feeding and discharging unit 81 is also mounted on the rotary side plate 80*c* at a location adjacent the plate cylinder 80*d*. The plate cylinder unit 80 is rotatable relative to an ink feeding means 87 inserted into the rotary cylinder 80*d*. The plate feeding and discharging unit 81 has a master feeding section 83 for storing a stencil master 82 in a rolled state, a platen roller 84, a thermal head 85 and a discharging roller 86 for winding a used master therearound. The plate cylinder unit 80 has a peripheral wall 80*a* a part 80*b* of which is constructed so as to be ink permeable. An ink fed from the ink feeding means 87 is fed through the part 80*b* to a printing paper (not shown).

With the stencil master printing device described in the above publication, however, since even the thermal head of the plating section is mounted on the plate feeding and discharging unit, the plating section becomes so heavy that the rotation of the plate cylinder unit cannot be smoothly performed. Additionally, there are defects that it is difficult to install wiring for feeding signals for the thermal head and that foreign matters such as paper powder are adhered to the thermal head to cause perforation troubles.

To overcome these defects, JP-A-H6-247024 proposes an apparatus as shown in FIG. 20, in which perforation means is disposed outside of a rotation system of a plate cylinder and is fixed to a body of the apparatus. In this case, it is easy to install wiring for a thermal head. In FIG. 20, designated as 1 is a plate cylinder unit, 4 a shaft, 8 a plate cylinder, 9 an ink permeable peripheral wall portion, 10 an ink feeding unit, 20 a plate feeding and discharging unit, 21 a stencil master, 22 a master feeding section, 23 a platen roller, 24 a discharged plate winding section, 30 a thermal head unit, 31 a thermal head and 31' is the thermal head in an advanced position.

In the above device, too, the feeding and discharging unit 20 including the rolled master, platen roller opposite the thermal head, and parts for the discharge of plates is disposed outside the plate cylinder 8 for rotation therewith, the weight is very large. Also, similar to the case of FIG. 19, a pressure roller for pressing the printing paper to the master attached to the plate cylinder is required to perform a motion of significantly departing from the plate cylinder each one revolution of the plate cylinder in order to avoid the collision against the feeding and discharging unit. This causes problems of enlargement of the printing apparatus, generation of noises, and complication of the apparatus. While the press roller might be arranged to have a large diameter and is provided with a recess to escape from the rolled master, etc., enlargement and cost-up of the apparatus are unavoidable.

A further proposal has been made in which the rolled master is disposed inside the plate cylinder. In this case, it is necessary for the ink roller disposed inside the plate cylinder to pass over the bar in each one revolution of the plate cylinder. This causes the generation of noises and complication of the apparatus.

SUMMARY OF THE INVENTION

It is, therefore, the prime object of the present invention to provide, in view of the problems of the conventional techniques, a stencil printing method and a device therefor, which permits the printing without cutting a stencil mater, which can transfer a stencil master having a low stiffness such as a film, which does not require complicated plate mounting and removing mechanisms, which does not require an increase of the weight of a rotary plate cylinder unit, and which can minimize the movement of an ink roller for escaping in each one revolution. Another object of the present invention is to provide a stencil printing method and a device therefor, which can be applied to a multi-color printing. It is a third object of the present invention to provide a stencil printing method and a device therefor, which can minimize enlargement of the printing device, generation of noises and complication of the device and which permits both sides printing.

In accordance with the present invention, there is provided a stencil printing method, characterized in that an ink permeable belt is mounted with a tension, in that a stencil master is disposed on one side of said ink permeable belt to form a printing section, said stencil master extending between a feeding part and a drawing part, in that a printing paper is attached to said stencil master, and in that ink feeding means is displaced while being maintained in contact with said ink permeable belt, so that the ink penetrates through said ink permeable belt and said stencil master and exudes therefrom to form a print on said printing paper.

The present invention also provides a stencil printing method, characterized in that an ink permeable belt is mounted with a tension so as to have opposing surfaces, in that a stencil master which has been fed in an elongated state and which is provided with thermal perforations is disposed, without being cut, on both opposing surfaces of said ink permeable belt to form a pair of printing sections, in that a printing paper is introduced to said printing sections, and in that a pair of ink feeding means are displaced while pressing said ink permeable belt, said stencil master and said printing paper, so that the ink penetrates through said ink permeable belt and said stencil master and exudes therefrom to form prints on both sides of said printing paper.

The present invention further provides a stencil printing apparatus, comprising an ink permeable belt mounted with a tension, a stencil master disposed on one side of said ink permeable belt to form a printing section, said stencil master extending between a feeding part and a drawing part, ink feeding means disposed on the other side of said ink permeable belt, and a perforation section for forming perforations in a thermoplastic resin film to form said stencil master, characterized in that, in printing, said ink permeable belt is maintained substantially stationary whereas said ink feeding means is displaced while being maintained in contact with said ink permeable belt, so that the ink penetrates through said ink permeable belt and said stencil master and exudes therefrom.

The feature of the stencil printing method and apparatus according to the present invention resides in that an ink feeding means is reciprocated relative to an ink permeable belt at the time of printing. Thus, the method and apparatus are distinct from the known rotary stencil printing in which a plate cylinder (corresponding to the ink permeable belt) performs rotational movement. Namely, when a second printing is carried out after the first print has been obtained, the ink feeding means is moved relative to the ink permeable belt and returned to the print starting position at which the first printing was performed.

The second printing may be performed during the return to the position at which the first printing was performed. The above method is basically different from a method in which an ink feeding means is moved in one direction relative to an ink permeable belt at the time of printing. The printing here means continuous printing of at least two sheets of printing papers during which the ink feeding means performs the reciprocating movement relative to the ink permeable belt. The reciprocating movement may be such that the ink permeable belt is maintained stationary while the ink permeable belt reciprocates or such that both members are moved to perform reciprocation.

BRIEF DESCRIPTION OF THE DRAWINGS

Other objects, features and advantages of the present invention will become apparent from the detailed description of the preferred embodiments of the invention which follows, when considered in light of the accompanying drawings, in which:

FIG. 3(*b*) is a schematic cross-sectional view showing a layer structure of a thermoplastic resin film used for the present invention, composed of a laminate of the thermoplastic resin film and a support of a porous material;

FIG. 8(*b*) is a view explanatory of movement of each color ink roller for performing four-color printing in FIG. 7, and showing an upper part of an arm having an ink roller at its lower end;

FIG. 8(*c*) is a view explanatory of movement of each color ink roller for performing four-color printing in FIG. 7, and showing a state of the arm slidingly moving along the stage;

FIG. 10(*b*) is a sectional view of the offsetting driving mechanism of FIG. 10(*a*);

DETAILED DESCRIPTION OF THE PREFERRED EMBODIMENTS OF THE INVENTION

Figure 1:
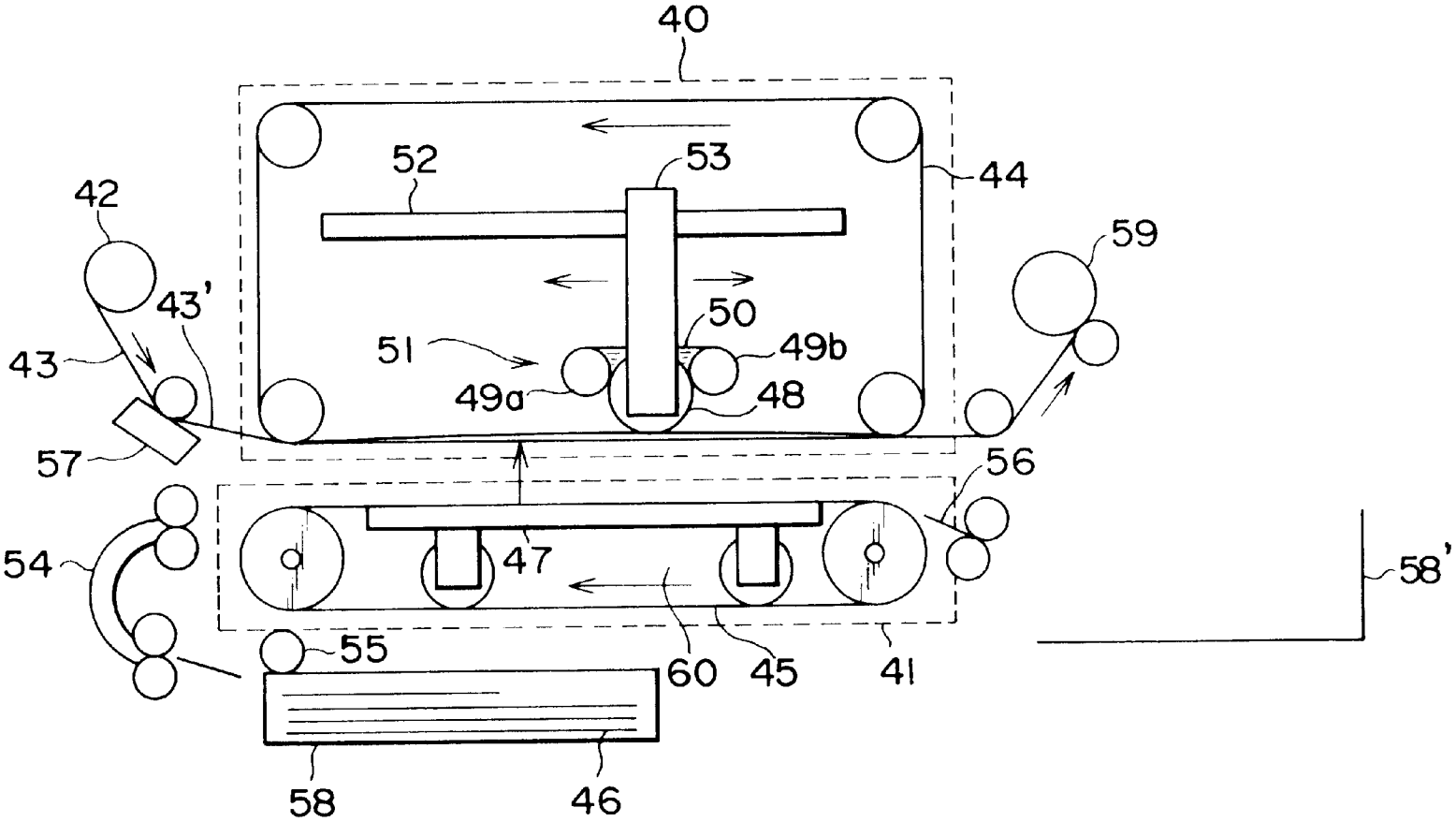
FIG. 1 is a schematic illustration of an essential part of a first embodiment according to the present invention.

FIG. 1 is a schematic illustration of an essential part of a first embodiment. However, the present invention is not limited to FIG. 1 and the operation thereof.

[Operation Example]

Figure 3A:
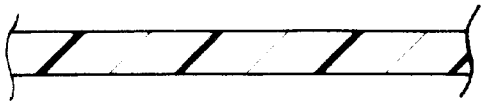
FIG. 3(*a*) is a schematic cross-sectional view showing a layer structure of a thermoplastic resin film used for the present invention, consisting only of the thermoplastic resin film.
Figure 3B:
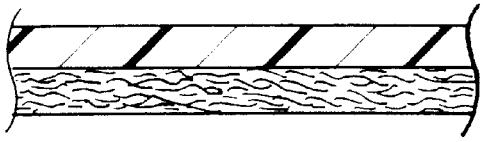

The embodiment of FIG. 1 uses a stencil master having a constitution as shown in FIG. 3(*a*) described hereinafter, namely composed substantially of a single film.

1. Setting of thermoplastic resin film

A thermoplastic resin film 43 fed from a feeding roller 42 is passed between a printing section 40 and a pressing unit 41, displaced rightward as shown in FIG. 1 and wound around a plate discharging roller 59. Instead of winding around the discharged plate winding section 59, the used thermoplastic resin film may be cut and collected in a plate discharging box (not shown).

2. Perforation and preparation for printing

The thus set thermoplastic resin film 43 is perforated with a thermal head 57, while being displaced rightward, and is then mounted on the printing section at a predetermined position. The perforation of the thermoplastic resin film may be carried out not only by a thermal head but also by a laser.

Printing papers are fed one by one by means of a roll 55 and each passed through a guide 54. The leading edge of the paper is then brought into contact with the pressing belt 45. At least a part of the pressing belt 45 is provided with air passage holes extending continuously in the thickness direction. An inside space 60 defined by the pressing belt 45 is maintained at an air pressure lower than that outside thereof, so that the printing paper 46 is attracted to the pressing belt 45 by suction. The paper is displaced with the belt to a predetermined position and is stopped there. Then, the pressing unit 41 is moved upward and is contacted with the printing section 40.

3. Printing

Printing is performed with an ink roller 48 which is held by a holding member 53 leftwardly and rightwardly slidably supported to a slide bar 52 and which is moveable leftwardly and rightwardly while being maintained in pressure contact with the ink permeable belt 44 with a suitable pressure. In the illustrated embodiment, the thermoplastic resin film 43 and the ink permeable belt 44 are made stationary, while the ink roller is displaced. Alternatively, the ink roller 48 may be made stationary with the thermoplastic resin film 43, ink permeable belt 44 and printing paper being arranged to be displaced. An ink 50 is fed through a pipe (not shown) and retained in a suitable amount in an ink reservoir defined by the ink roller 48 and doctor rollers 49*a* and 49*b*.

4. Paper delivery and feed

The pressing unit 41 is displaced downward as shown in FIG. 1. The pressing belt 45 is then rotated clockwise. The printed paper is removed from the pressing belt 45 with a claw 56 and is delivered to a delivery tray 58'. In this case, a new printing paper 46 is fed on the pressing belt 45. The printing is repeated to obtain a predetermined number of prints.

5. Discharging and preparation of form plate

After completion of printing, the thermoplastic resin film 43 (stencil master 43') is displaced together with the ink permeable sheet 44 and is wound around the plate discharging roller. Alternatively, the film may be cut and stored without being wound. At the same time, a newly fed thermoplastic resin film is treated with the thermal head 57 to initiate the next master formation.

Next, the main constituents will be described.

The ink permeable belt is an assembly of a single one of or a mixture of fibrous substances such as fibers made of, for example, wool, cotton, rayon, vinylon, polyamide, polyester, polyacrylate, polyvinyl chloride, polyvinylidene chloride or fluorine resin; carbon fibers; metal fibers of, for example, stainless steel, copper, aluminum; ceramic fibers; or glass fibers. More particularly, the ink permeable belt may be made of a non-woven fabric, a mesh-like fabric, or a sintered material. Metal fibers, ceramic fibers and glass fibers can give desired products having preferable characteristics upon being sintered. ("Porous Materials-property and application", published by Gihodo Shuppan Co., Ltd. (Daiichi Kowa Bldg., 11-41, Akasaka 1-chome, Minato-ku, Tokyo, editor: Renichi Kondo; "Porous Material Handbook", published by IPC (Taiyo Bldg., 22-27, Hyakuninncho 1-chome, Shinjuku-ku, Tokyo, editor: Jun Kamisawa and Masanobu Someya)

When an ink permeable belt alone is insufficient for constructing a plate cylinder because of its low rigidity, it is necessary for one or more rigid layers to be provided inside the belt. Illustrative of such layer is a punch metal (a metal plate provided with a multiplicity of perforations).

The diameter of the fiber adjacent at least a surface of the fibrous substance at which the fibrous substance is brought into contact with the thermoplastic resin film 43 is preferably 0.5–20 $\mu$m. A fibrous substance having a diameter of less than 0.5 $\mu$m is difficult to produce, requires high costs and is low in strengths. A diameter of perforations formed in the thermoplastic film 43 by the thermal head 57 is 10–60 $\mu$m. No merits may be obtained when the diameter of the perforations is smaller than the lower limit. When the fibrous substance has a diameter of greater than 20 $\mu$m, passage of an ink is prevented, so that so called "white spots" are apt to be formed in the image. This adversely affects a grade of the image.

A permeability value of the ink permeable belt 44 is an important characteristic thereof. It is preferred that the permeability value be in the range of 3.0–250 $cm^3/cm^2$.second when measured by Permeameter (permeability testing device manufactured by Toyo Seiki Seisakusho Co., Ltd.). A permeability value of less than 3.0 $cm^3/cm^2$.second causes a difficulty in passing an ink so that an image becomes blurred. On the other hand, when the permeability value is greater than 250 $cm^3/cm^2$.second, the ink passes too much so that a large amount of the ink is accumulated between a stencil master and the ink permeable belt 44. The accumulated ink is apt to leak from their side portions or to deposit in an excess amount on a printing paper, causing fouling of the image and penetration of the ink to backside of the printing paper.

The thickness of the ink permeable belt 44 may vary according to the shape, material, shape of holes, permeability value, structure, etc. of the fibrous substance from which the belt is formed. Generally, however, the thickness is in the range of about 30–3,000 $\mu$m. A thickness of less than 30 $\mu$m results in low strengths. Too large a thickness in excess of 3,000 $\mu$m causes retention of a large amount of an ink and causes a problem in printing after a long period of stop.

As an example of a metal fiber of the ink permeable belt 44, there may be mentioned a porous sintered body of a stainless steel fiber having a diameter of 3–15 $\mu$m. A belt of such a fiber with a thickness of 100–300 $\mu$m may be used.

Figure 4:
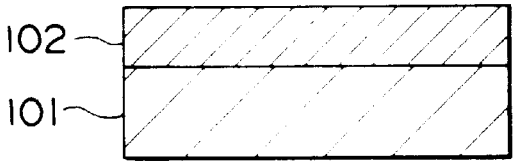
FIG. 4 is a schematic cross-sectional view showing an example of a layer structure of an ink permeable sheet used in the present invention.

Further, the ink permeable belt may be in the form of a laminate. FIG. 4 is a sectional view of one embodiment of such a laminate. Designated as 101 is a non-woven fabric having a base weight of 12 $g/m^2$, made from a polyester fiber of 0.2–1.5 denier and located on an outer side (on a side which is brought into contact with a thermoplastic resin film). Designated as 102 is an inner side layer of a nylon mesh and bonded with an adhesive to the fabric 101 for reinforcing same.

Figure 5:
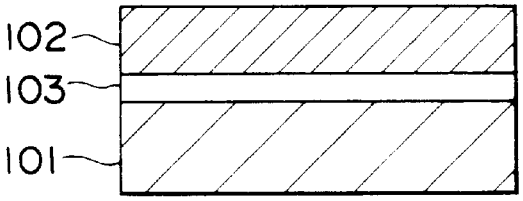
FIG. 5 is a schematic cross-sectional view showing another example of a layer structure of an ink permeable sheet used in the present invention.

FIG. 5 is a sectional view of another embodiment in which non-woven fabrics 101 and 101' each made from a polyester fiber of 0.2–1.5 denier are laminated on both sides of a mesh 103.

Figure 6:
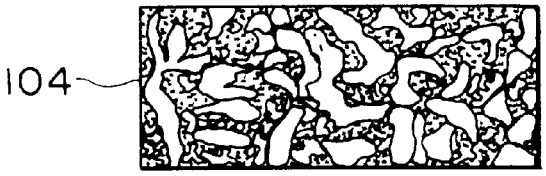
FIG. 6 is a schematic cross-sectional view showing a further example of a layer structure of an ink permeable sheet used in the present invention.

The ink permeable belt 44 can be not only an assembly of the above fibrous substance but also a porous belt having a multiplicity of open cells 104 continuous in the thickness direction (FIG. 6).

The diameter of the fiber adjacent at least a surface of the fibrous substance at which the fibrous substance is brought into contact with the thermoplastic resin film 43 is preferably 0.5–20 μm. It is preferred that the permeability value be in the range of 3.0–250 $cm^3/cm^2$.second when measured by Permeameter (permeability testing device manufactured by Toyo Seiki Seisakusho Co., Ltd.). The thickness of the porous belt of FIG. 6 is in the range of about 30–3,000 μm. A thickness of less than 30 μm results in low strengths. Too large a thickness in excess of 3,000 μm causes retention of a large amount of an ink and causes a problem in printing after a long period of stop.

Figure 2:
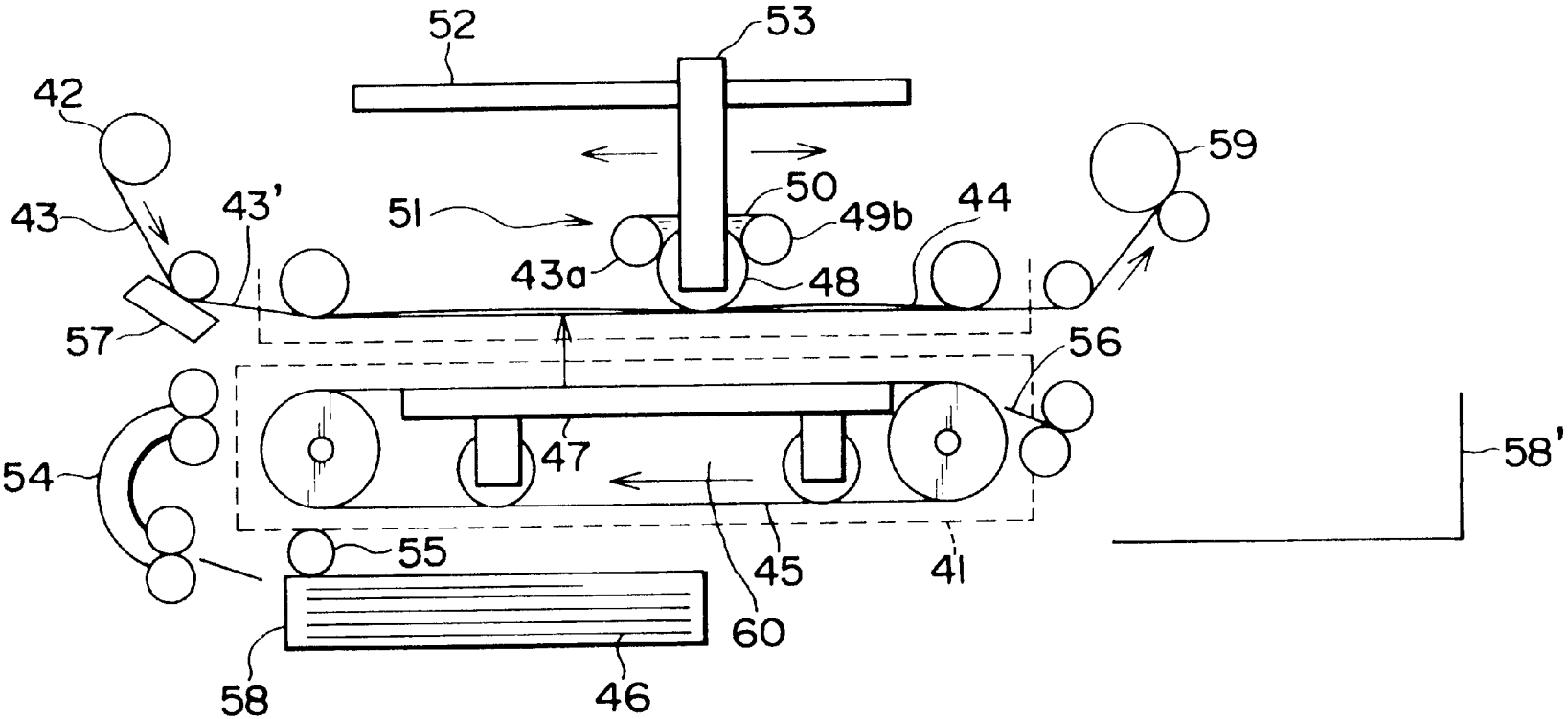
FIG. 2 is a schematic illustration of an essential part of a modified example of the first embodiment according to the present invention.

FIG. 2 depicts a variation of the first embodiment. In this embodiment, in place of a circular belt (endless belt), a sheet like material (belt-like material) is used as the ink permeable belt 44. Thus, this embodiment differs from the above embodiment in that the belt is stationary.

A pressing belt 45, while supporting a printing paper 46 thereon, transfers the paper to a predetermined position and withstands a printing pressure by an ink roller 48, so that a printing image is formed on the printing paper. The pressing belt also functions to transfer the printing paper after the printing to a predetermined location.

The structure of the pressing belt 45 may be quite the same as that of the pressing belt 45 shown in FIG. 1. Preferably, the belt is a belt-like sheet having a multiplicity of through-holes continuous in the thickness direction throughout the whole surface thereof or a belt-like sheet having a multiplicity of through-holes continuous in the thickness direction in a particular part thereof.

A space 60 surrounded by the pressing belt 45 may be in a reduced pressure or a pressurized state relative to the atmospheric pressure (no mechanism is shown). Under a reduced pressure, the printing paper 46 is absorbed on the pressing belt, whereas under a pressurized state the paper is peeled and separated therefrom. The holes serve to function as passages for air. The present invention, however, is not limited to the presence or absence of such holes. For example, for adhering the printing paper to the pressing belt, bonding or electrostatic function can be utilized. For peeling and separating, a peeling blade or suction force from outside can be utilized.

The pressing belt 45 may be made of a known plastic material. In the above-mentioned references ("Porous Materials-property and application", published by Gihodo Shuppan Co., Ltd. (Daiichi Kowa Bldg., 11-41, Akasaka 1-chome, Minato-ku, Tokyo, editor: Renichi Kondo; "Porous Material Handbook", published by IPC (Taiyo Bldg., 22-27, Hyakuninncho 1-chome, Shinjuku-ku, Tokyo, editor: Jun Kamisawa and Masanobu Someya), utilizable plastics are shown.

If necessary, in the space surrounded by the pressing belt 45, a support 47 for supporting the printing pressure by the ink roller 48 may be disposed. The support 47 has an essential part made from a plastic plate or a metal plate plate-like material having an opened portion. The support may also be formed from a plurality of rotatable rollers.

The thickness of the thermoplastic resin film 43 is 0.5–10 μm, preferably 1.0–3.0 μm. The thermoplastic film 43 may be treated to have antistatic properties. Such an antistatic treatment may be by dispersing or kneading a particulate inorganic material such as carbon or an organic antistatic agent (generally a surfactant) into a film material, or by dispersing or kneading same into a coating which is provided also for preventing sticking. The surfactant is a liquid and serves to reduce the electric resistance of the coated film or to reduce the electric resistance thereof by its moisture absorbing property.

The diameter of perforations formed in the thermoplastic resin film 43 by a thermal head 57 is suitably 10–60 μm. The thus obtained stencil master 43' is known per se. The thermoplastic resin film is preferably a stretched polyester film having a thickness of 0.5–5 μm without no support.

The thermoplastic film 43 may be not only one which consists only of a film capable of being perforated as shown in FIG. 3(*a*) but also one which has a conventional support as shown in FIG. 3(*b*). Further, a plurality of layers such as an adhesive layer may be provided in addition to the above-described layer.

Figure 7:
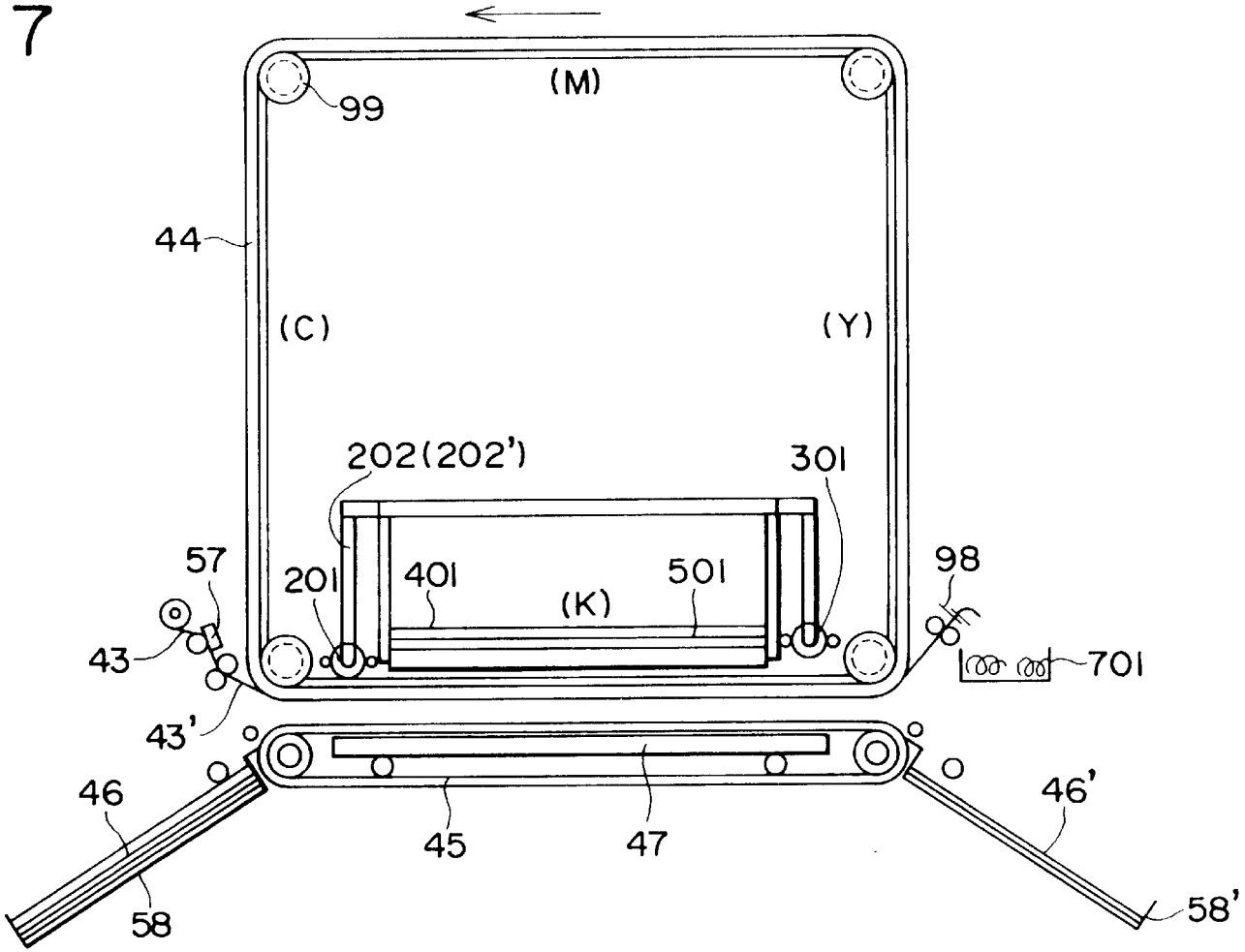
FIG. 7 is a schematic illustration of an essential part of a second embodiment according to the present invention.

FIG. 7 is a schematic illustration of an essential part of a second embodiment (multi-color printing). The present invention, however, is not limited to FIG. 7 or its operation.

The embodiment shown in FIG. 7 pertains to a multi-color printing method and apparatus. In the present invention, a wounded thermoplastic resin film 43 is fed as an elongated state without being cut and is thermally perforated with a thermal head 57, so that a stencil master is formed. The stencil master 43' is mounted on an ink permeable belt 44 (corresponding to a plate cylinder). In performing the printing, neither the ink permeable belt nor the stencil master is moved. An ink roller 201 serving as an ink feeding means is moved while being maintained in contact with the ink permeable belt, so that the ink is exuded and transferred to a printing paper through the ink permeable belt 44 and the stencil master. In this case, the ink permeable belt 44 may be an elongated state or an endless state. However, it is preferred that the belt be in an endless state and have a flat surface from the standpoint of construction. The thermoplastic resin film 43 may be not only in the wound state (as a roll) but also in a folded state. In the latter case, the film is fed in an extended state. The ink feeding means may be not only in the form of an ink roller but also of a squeeze type, like a spatula, which is not rotated.

The printing paper 46 is displaced by a transferring section to a predetermined printing position facing to the stencil master 43' and is brought into pressure contact with the stencil master to perform the printing.

The pressure contact between the stencil master and the printing paper is carried out between the ink feeding means (ink roller 201) and the pressing belt 45. In the case of a rectangular cylindrical belt, the printing is carried out in the printing section of a flat surface thereof defined by being extended with a tension. In the case of a round cylindrical belt, the printing roller is reciprocated within a cylindrical printing section to perform the printing. Backup is made by a roller cooperating with the printing.

In the case of monochromatic printing, the printing paper after completion of the printing is separated from the stencil master 43' by function of a clamp or suction and is then separated from the transferring means including separation claws and rollers and collected on a predetermined storing section (tray 58'). The above procedure is repeated in a desired number of prints.

By a next print starting signal, the stencil master is displaced (in this case, the ink permeable belt 44 may or may not be displaced together with the stencil master), while a new thermoplastic resin film 43 drawn by a pulling section is fed. Thus, the portion in which the printing has been completed is separated from the ink permeable belt and is stored after being cut or as such (in an elongated state) or wound around a winding roller. At the same time, a perforated new stencil master is mounted to the ink permeable belt.

The apparatus shown in FIG. 7 is especially effective for multicolor printing. In FIG. 7, designated as K, C, M and Y are black, cyan, magenta and yellow color printing sections. It is without saying that the this apparatus can be used for a monochromatic printing as described above or for two or three colors printing.

A master perforated by K-color signals is mounted on a K-color section of the ink permeable belt 44. A printing paper is displaced to a predetermined position together with the rotating pressing belt 45. A pressing unit is moved upward so that the printing paper is brought into contact with the stencil master. An ink roller 201 for only K-color, oriented in the direction perpendicular to the plane of the drawing, is displaced from left to right in FIG. 7 while being maintained in contact with the ink permeable belt 44, so that the K-color ink is transferred to the printing paper. After the first print has been completed, the ink roller 201 returns to the original position while being maintained in a departed state. The printed paper is separated from the stencil master by being bonded to the pressing belt 45 by, for example, suction force and is transferred to a predetermined tray 58' by rotation of the pressing belt 45. After the desired number of prints have been obtained, the ink permeable belt is rotated counterclockwise in FIG. 7 with the K-color stencil master being supported by the belt. The stencil master is then separated from the ink permeable belt and is cut or wound around a roll. After the completion of the K-color printing, the K-color roller 201 is returned to the left side end and is separated from the ink permeable melt.

Next, the ink permeable belt C for C-color printing is displaced in a predetermined position. An ink roller 301 for only C-color printing is brought into contact with the ink permeable belt 44.

The printing paper 46' on which the K-color image has been printed is displaced from the tray 58' along a reversed path to the same position as in the previous printing and is brought into contact with a C-color stencil master. For the purpose of facilitating the feeding of the papers in the tray 58', the orientation or position of the tray 58' in the above stage may be changed from the state in which the papers have been collected therein. The ink roller 301 for C-color only is then displaced in the direction opposite to the previous direction while being maintained in contact with the ink permeable belt, so that the C-color ink is transferred to the paper 46'.

The paper to which a K-color and C-color image has been printed is then separated from the C-color stencil master and is displaced to the tray 58. In the above embodiment, the direction of the passage of the papers is reversed between the K-color and C-color. Alternately, the user can exchange the tray 58' (or the contents therein) with the tray 58 so that the printing and paper passage can be the same.

M-color and Y-color printing may be performed in the same manner. In this case, the M-color ink roller 401 and Y-color ink roller 501 are displaced in a direction perpendicular to the direction along which the master is displaced. The ink rollers 401 and 501 each have a length nearly the same as the length of the printing region in the direction of the movement of the stencil master. It is very difficult to dispose the four ink rollers so as to be displaced in the direction parallel with the master feeding direction. Such an apparatus becomes large in the master feeding direction and becomes complicated. Thus, for the reasons of design, the apparatus is selected as the above.

Contacting of guide rollers 99 with the ink permeable belt 44 causes fouling of the guide rollers 99. This will cause mixing of the color of the respective sections of the ink permeable belt 44 and respective ink rollers. To prevent such a fouling, it is desired that a cleaning device be provided or the surface of each of the guide rollers 99 be coated with a material (for example, a fluorine resin) to which the ink is prevented from depositing.

Figure 8A:
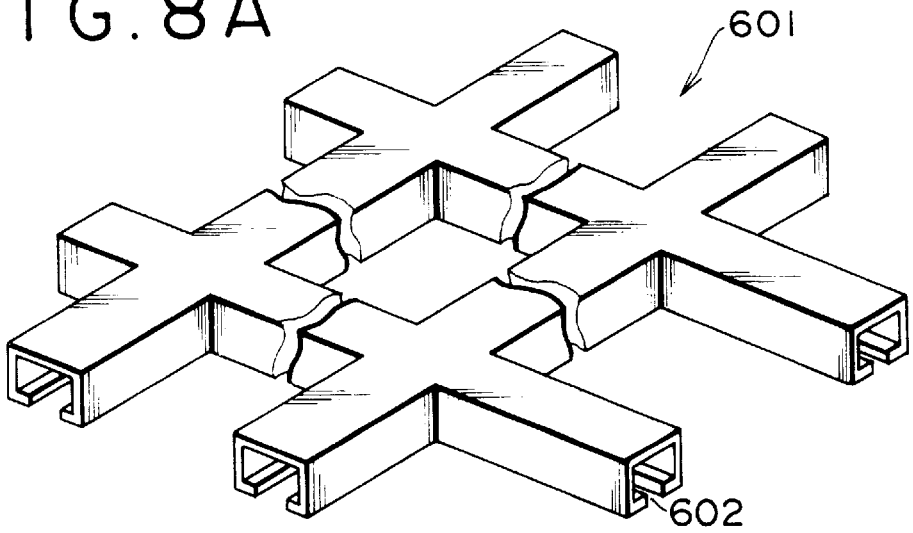
FIG. 8(*a*) is a view explanatory of movement of each color ink roller for performing four-color printing in FIG. 7, and showing a structure of a stage.
Figure 8B:
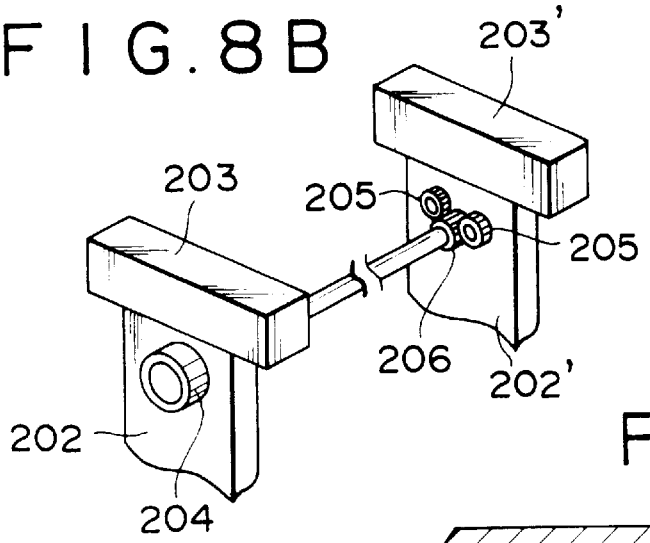
Figure 8C:
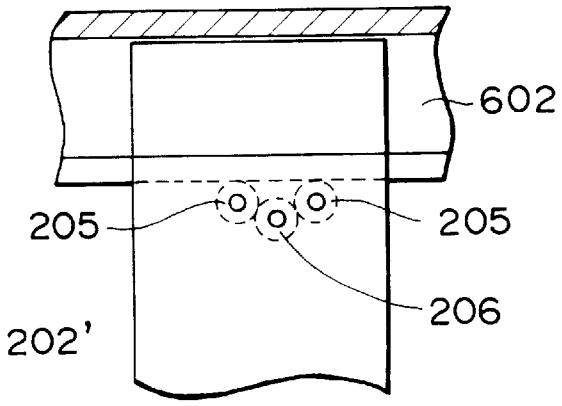

As shown in FIGS. 8(*a*)–8(*c*), the ink roller 201 is supported at its both ends by lower ends of a pair of arms 202 and 202' which are suspended from a stage 601 having a #-like structure and are able to be advanced or retracted in one direction.

The arms 202 and 202' have the upper ends provided with slide sections 203 and 203' which are inserted in luck portions 602 of the stage 601 and are displaceable therein. The arms 202 and 202' have lower ends provided with stopper members (not shown) by which respective ends of the ink roller 201 are secured to the arms. Both ends of the ink roller 201 are supported by the paired arms and the roller is made displaceable.

The displacement of the ink roller 201 is carried out by rotating gears 205, attached to the arm 202' in engagement with a rack 602 of the stage 601, by means of a motor 204 mounted on the arm 202. Designated at 206 is an idler gear. The displacement of the slide sections 203 and 203' supported by the stage 601 can be carried out in any other known means.

Four such ink rollers are provided for respective C, M, Y and K colors.

Figure 9:
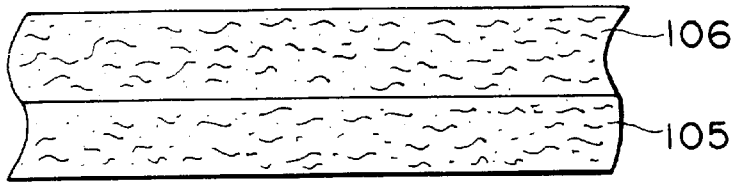
FIG. 9 is a schematic cross-sectional view showing a further example of a layer structure of an ink permeable sheet used in the present invention.

As the ink permeable belt 44 of FIG. 7, those described in connection with FIGS. 1–6 may be used as such. One preferred example of the belt is a cylindrical belt having a thickness of 100–800 $\mu$m and made of porous sintered body of stainless steel fibers having a diameter of 3–15 $\mu$m. A punched metal having perforations of several tens $\mu$m to several mm. The belt may be formed from a plurality of layers. FIG. 9 is a sectional view showing one example of such a belt. Designated as 105 is an outer layer (a side in contact with a stencil master) made of porous sintered body of stainless steel fibers having a diameter of 3–15 $\mu$m and having a thickness of 50–700 $\mu$m. Designated as 106 is an inner layer (a side in contact with an ink roller) made of porous sintered body of stainless steel fibers having a diameter of 20–100 $\mu$m and having a thickness of 50–200 $\mu$m.

In the ink permeable belt having a two-layer structure as shown in FIG. 9, it is desired that the two layers be slidable relative to each other for reasons of preventing the occurrence of ghost images. Those portions of the ink permeable belt which correspond to the image portions of the stencil master in the previous printing have a smaller content of remaining ink than the other portions thereof corresponding to the background portions, because a larger amount of the ink has been passed through the former portions than the latter portions. Therefore, when a succeeding printing is started, the image density becomes lower in those portions so that a ghost image tends to appear.

When a stencil master has a support, appearance of such a ghost image is not significant because the support can disperse such an undesirable effect. In the case of a master composed of a single film, on the other hand, the problem of ghost is significant because such an influence sometimes occurs after only several prints have been obtained. In the present invention, the stencil master is sandwiched between the ink permeable belt and the printing paper during printing. These elements are not moved during printing. Thus, the stencil master is subjected only to a force in the thickness direction. Therefore, a number of prints can be produced even without a support for retaining strengths in the stencil master. (In the conventional rotary stencil printer, a plate cylinder around which a master is attached is rotated for contacting with a printing paper. Thus, the master is subjected to a force by the paper in the direction opposite the rotational direction and is apt to cause troubles such as breakage, stretch, wrinkles or detachment from the plate cylinder. This is one of the important reasons for the need of a substrate.)

The two layers are displaced relative to each other at the start or completion of the printing or during printing. The displacement length is arbitrarily determined. Generally, however, the displacement is less than several millimeters. Too small a displacement is not effective. Since too large a displacement may result in overlapping of different colors, there is an upper limit in the displacement.

Figure 10A:
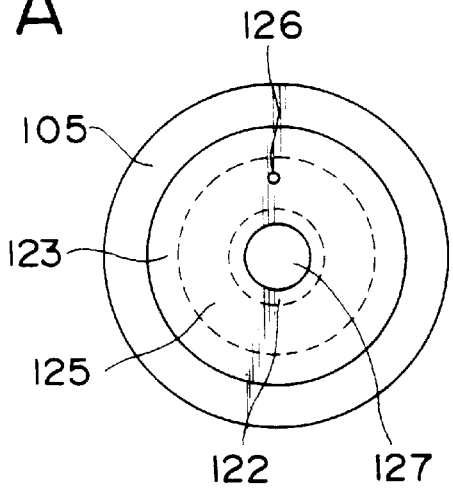
FIG. 10(*a*) is a side view showing an example of an offsetting driving mechanism.
Figure 10B:
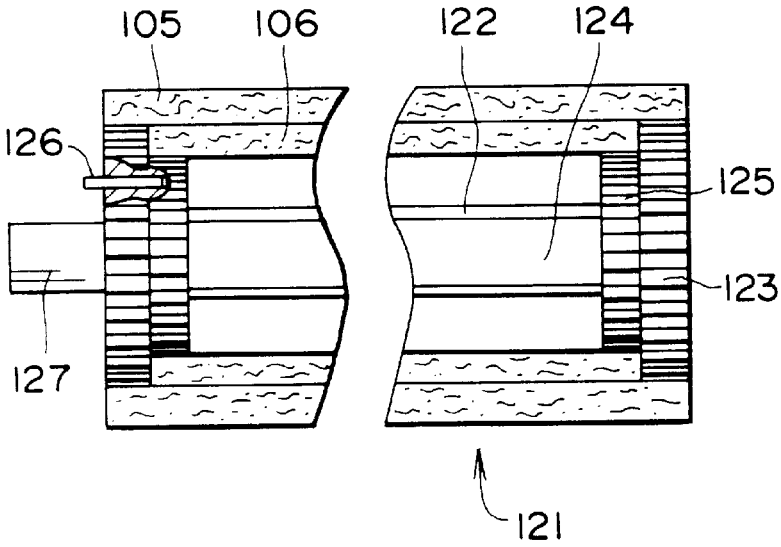

FIGS. 10(*a*) and 10(*b*) illustrate an embodiment for a driving mechanism for such a displacement. A driving section 121 has dual axes. An outer axis 122 secures a large diameter gear 123, while an inner axis 124 secures a small diameter gear 125. The inner axis 124 has a protruded portion 127 which receives a driving force from a motor. When the two layers are displaced relative to each other, a pin 126 for fixing the large diameter gear 123 to the small diameter gear 125 is removed. Thus, when only the small diameter gear 125 is rotated, the inner belt 106 is displaced. Since displacement in the one direction will cause color mixing, the above rotation is both directions. The ink permeable belt in the above embodiment may be formed not only of an assembly of the above-described fibrous substance but also of a belt having a multiplicity of through holes in the thickness direction.

Figure 11:
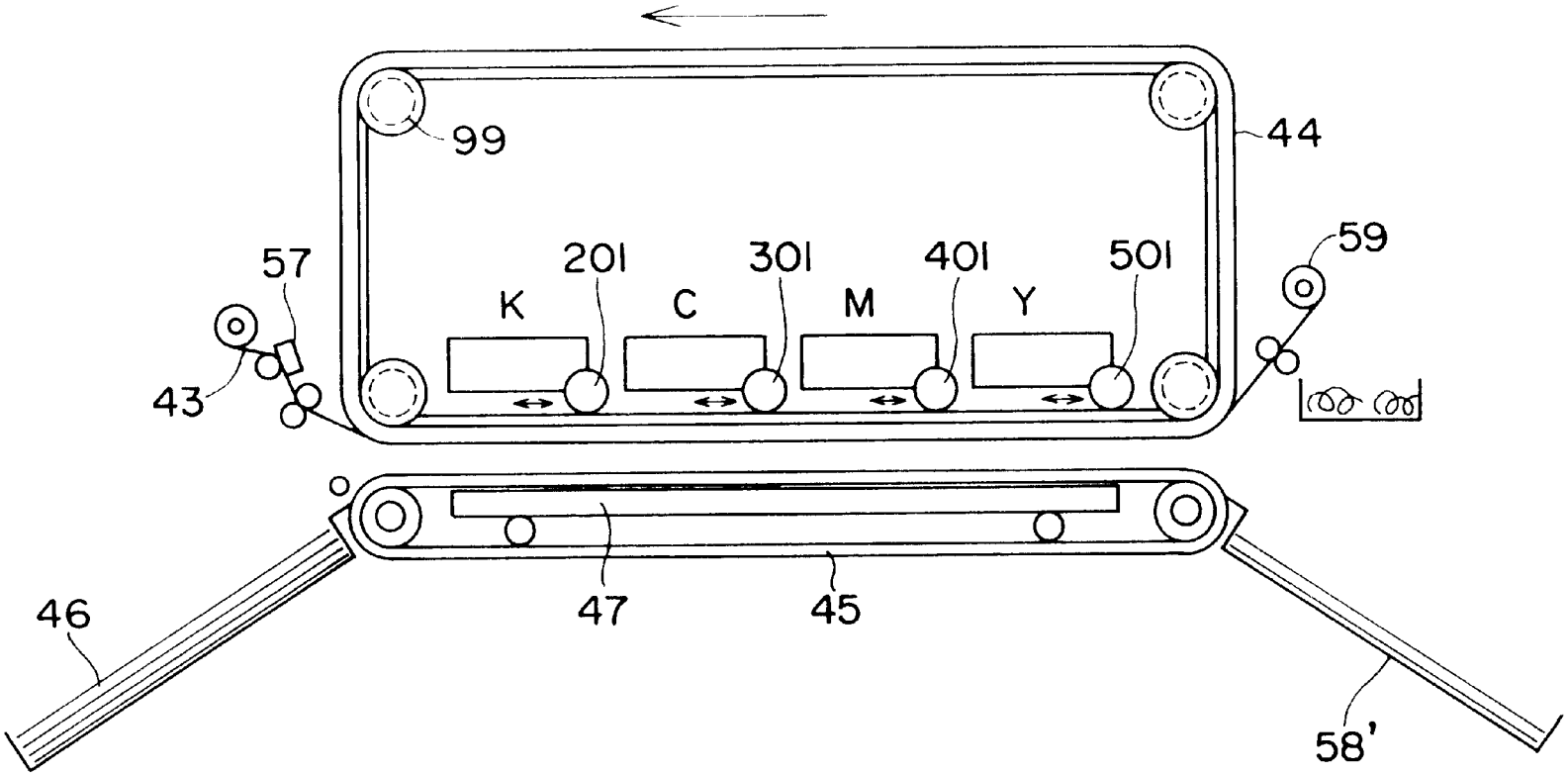
FIG. 11 is a schematic illustration of an essential part of a modified example of the second embodiment according to the present invention.

FIG. 11 shows another embodiment for four-color printing. A flat surface having a length sufficient to form four color printing sections is provided. A thermoplastic resin film 43 is perforated for four colors C, M, Y and K. Thereafter, respective ink rollers 201, 301, 401 and 501 are simultaneously displaced from right to left in FIG. 11 to print respective colors. After printing, each ink roller is returned to the right side position. The printing paper is then displaced by a distance corresponding to one sheet (one color). The printing paper on which four colors have been printed is removed from a pressing belt 45 with a separation claw and is collected in a tray 58', thus terminating the four-color printing. Such procedures are repeated. In removing, the stencil master is wound around a take up roller by a length corresponding to the four-color portions. At the same time, perforations are formed for another four-color portions for the next printing.

Next, simultaneous both sides printing which is a third embodiment of the present invention will be described. In this embodiment, a rolled or folded stencil master is fed in an elongated state without being cut and is perforated to form a master. Then, the master is mounted on an ink permeable belt. In printing, the ink permeable belt is maintained substantially stationary while an ink roller being an ink feeding means is displaced while being in contact with the belt, thereby the ink is exuded and transferred to a printing paper or film. The ink permeable belt may be elongated or circular.

Figure 12:
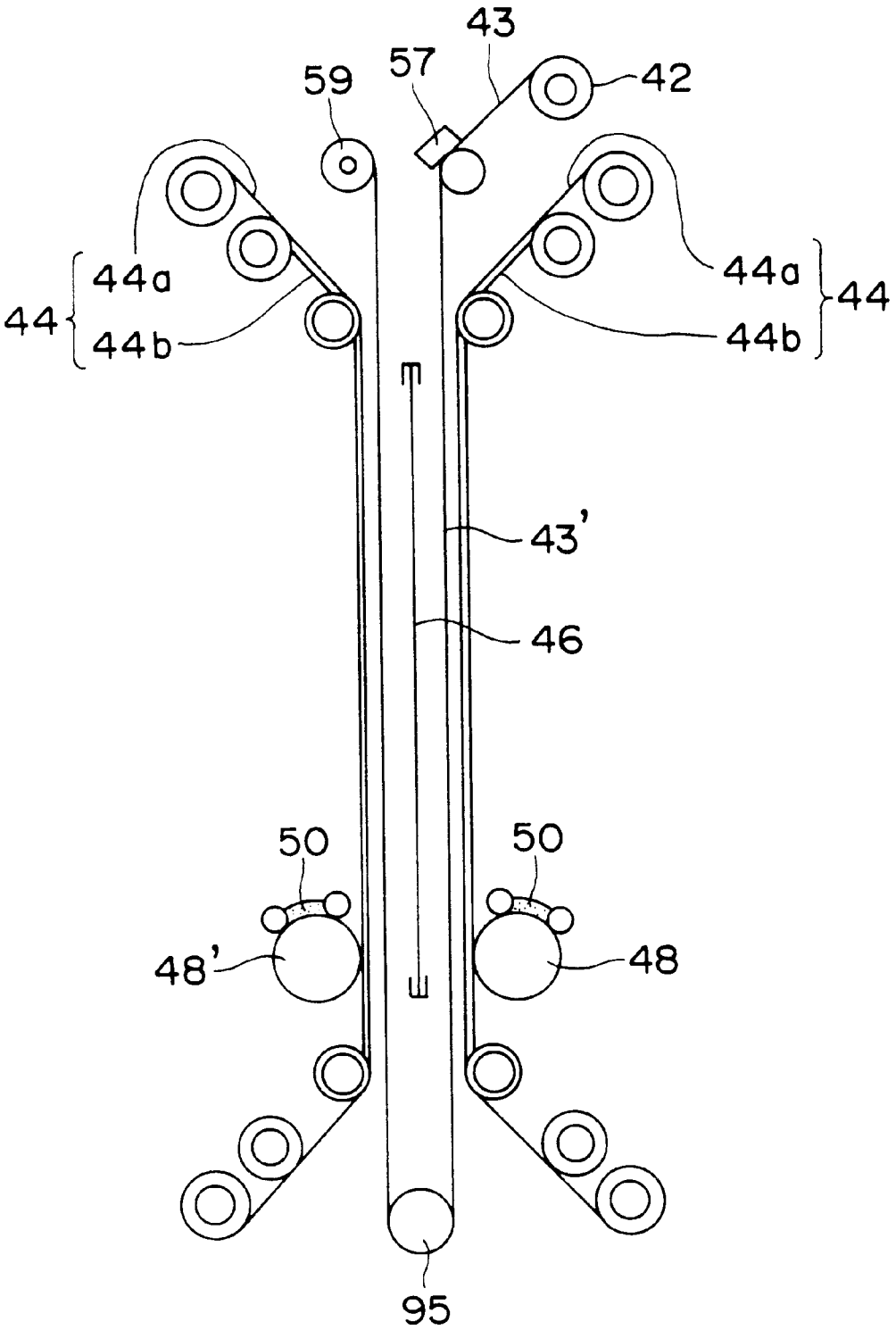
FIG. 12 is a schematic illustration of an essential part of a third embodiment according to the present invention.

In FIG. 12, the ink permeable belt is composed of a pair of elongated belts. Each belt has a double layer structure consisting of layers 44*a* and 44*b* which are displaceable relative to each other. A rolled thermoplastic resin film 43 is fed to a thermal head 57 where an image for printing on one side is first perforated and then another image for printing on the other side is perforated. The master 43' is displaced upward and downward in FIG. 12, but may be displaced from backside of the drawing to the front side thereof or vise versa. After the stencil master 43' has been attached to the ink permeable belts and after a printing paper 46 has been set between portions of the stencil master 43', the gap between the ink permeable belts is narrowed. Then, a pair of ink rollers 48 and 48' are moved from one end to the other end of the double layered ink permeable belts while being maintained in pressure contact with each other, so that printing is carried out on both sides of the paper 46.

Figure 13:
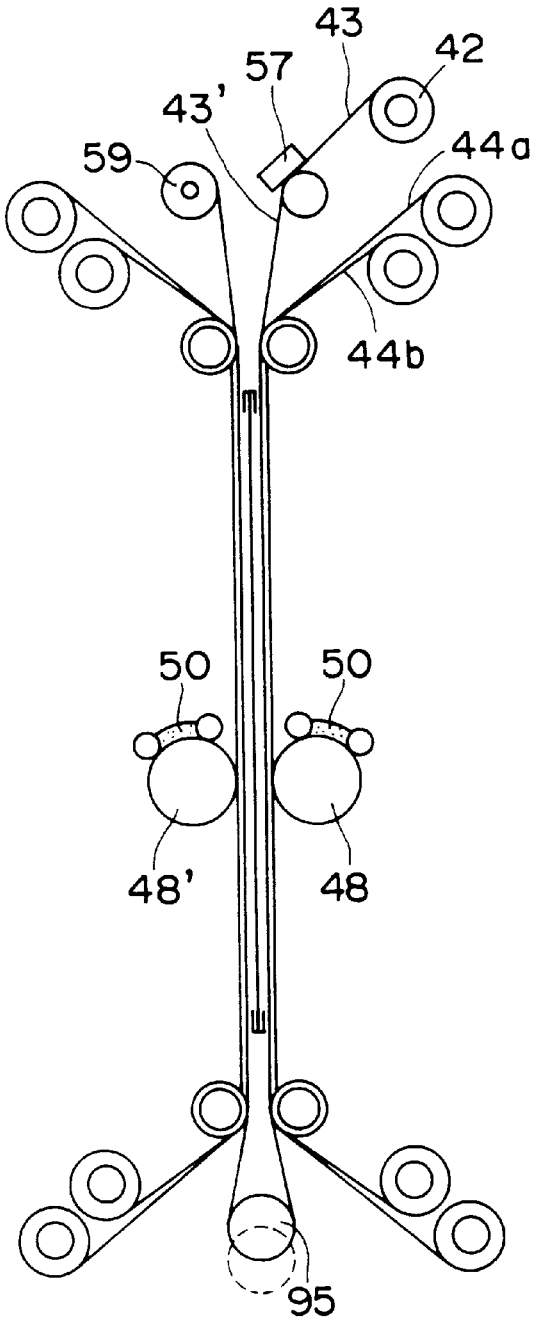
FIG. 13 is a schematic illustration of an essential part of a modified example of the third embodiment according to the present invention.

FIG. 13 shows a state where both sides printing is being carried out. In this case, the gap between the paired ink permeable belts 44 may be closed with the stencil master 43' being attached thereto. Alternately, only portions at which the ink rollers 48 and 48' are contacted may be contacted by being pushed thereby with the other portions being maintained spaced apart. A master guide roller 95 (FIG. 12) is slightly displaced upward.

The printing paper 46 is displaced from the backside of the drawing to the front side thereof or vise versa. The orientation of the printing paper is in accordance with the orientation of the ink permeable belt and is not specifically limited. The orientation may be from vertical, namely at an angle of 90° relative to the horizontal direction to horizontal, namely at an angle of 0° relative to the horizontal direction. In the case of nearly horizontal position, for example, when the paper is displaced while being supported or displaced at a predetermined velocity or more while being supported only at its tip end, a problem of fouling of the paper by the ink which might occur by contact of the paper with the ink permeable belt can be solved by utilizing an air stream flowing from the displacing direction of the paper. Irrespective of the shape of the ink permeable belt, the paper can be passed and printed between the opposing ink permeable belts supplied from the rolls and then taken into a roll, folded or cut into sheets.

In this case, problems in transference of the paper and problems of adhesion of printed paper to the master may be relatively more easily solved as compared with the case in which the paper is cut into a sheet.

After completion of the printing, the gap between the double layered-ink permeable belt and the gap between doubled portions of the stencil master are expanded. The printed paper is discharged between the doubled portions of the stencil master. The thermoplastic resin film 43 is subjected to a new master forming process and is displaced while being wound. In this case, when at least the layer 44*a* or 44*b* of the ink permeable belt 44 is displaced relative to each other, a ghost of the just printed image can be effectively minimized. Of course, it is possible not to perform such a displacement. In the illustrated embodiment, the both sides printing is carried out with a single continuous stencil master supplied from a feed roller.

In the present invention, the both sides printing can be carried out using two separate stencil masters. In this case, it is preferred that two thermal heads be used in correspondence to respective masters.

Figure 14:
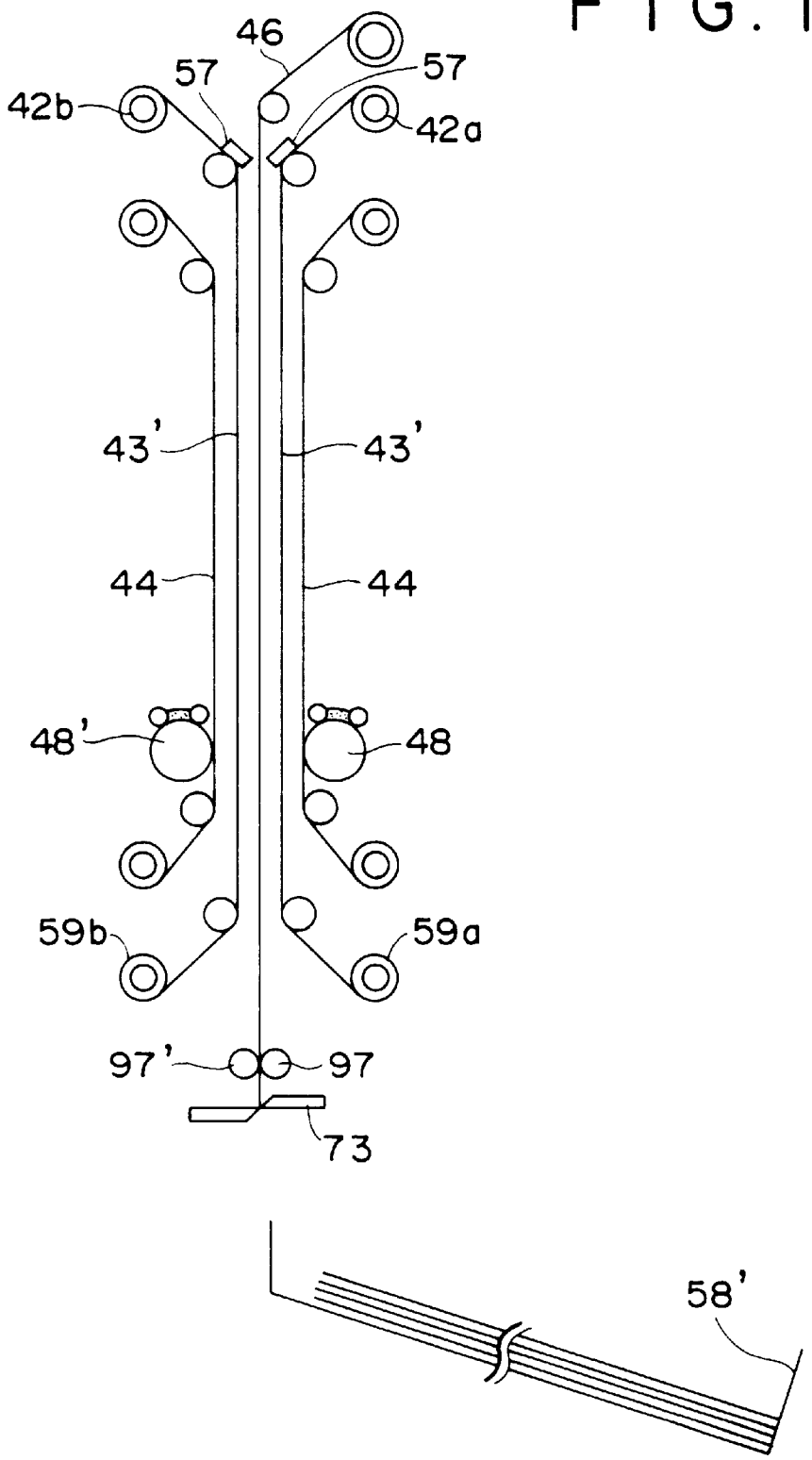
FIG. 14 is a schematic illustration of an essential part of a modified example of the third embodiment according to the present invention.

FIG. 14 is a schematic illustration for performing the above method. Stencil masters 43' and 43' which have been fed from feeding rollers 42*a* and 42*b* and have been perforated are taken by take up rollers 59*a* and 59*b*. In the illustrated embodiment, a printing paper 46 is fed from a roll and printed. Thereafter the paper is passed, without being cut, through guide rollers 97 and 97' and then cut with a cutter 73 and received in a discharge tray 58'. While the paper in the illustrated embodiment is maintained in an elongated state until the printing is terminated, it is possible that the paper is in a form of a sheet from the beginning. In this case, the printing paper is moved from an upper part to a lower part while being clamped at its upper edge. It is desired that an air stream be formed on each of the both sides of the paper so that the paper is not fouled, before printing, by contact with the stencil masters on both sides thereof.

Figure 15:
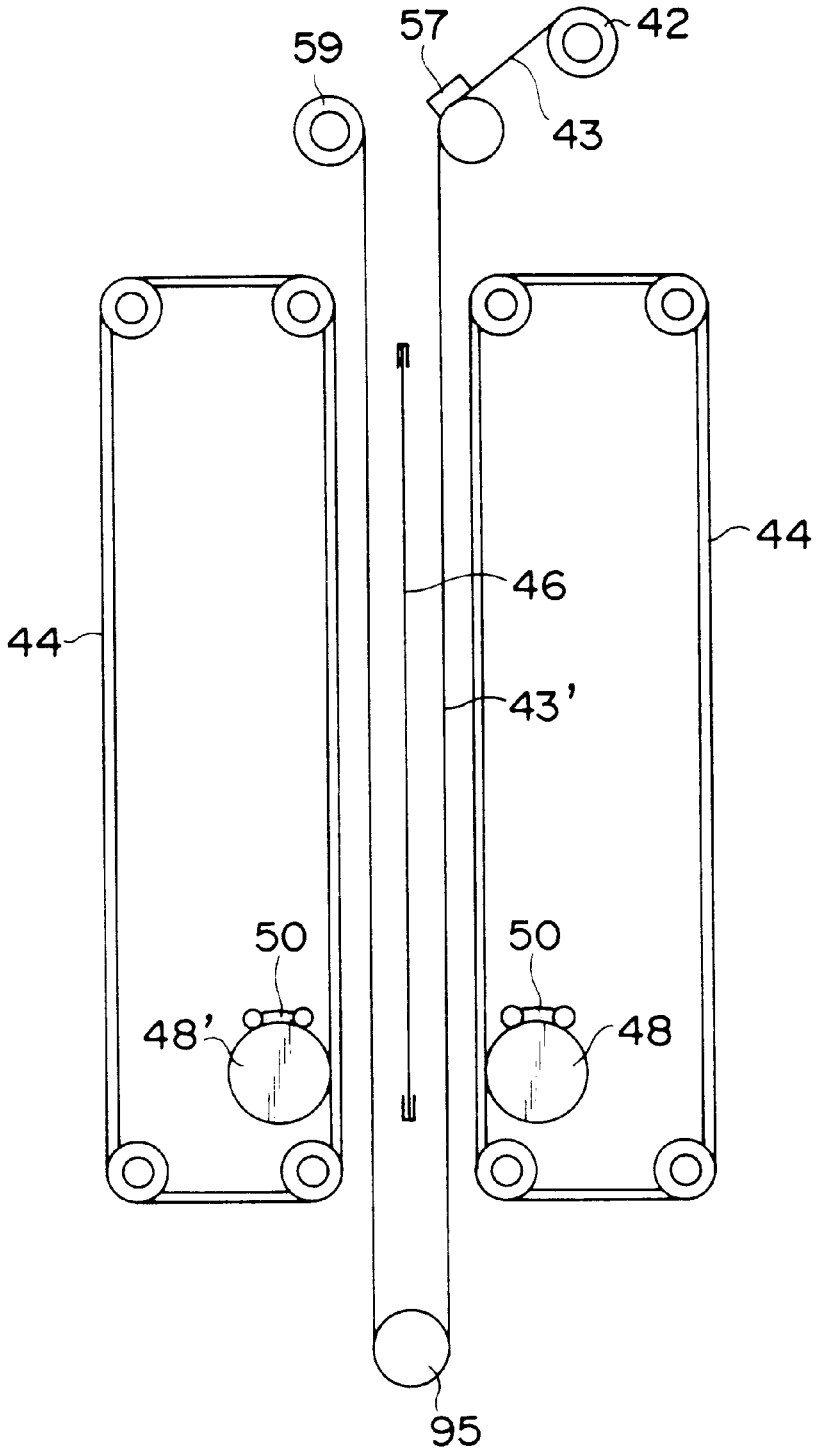
FIG. 15 is a schematic illustration of an essential part of a modified example of the third embodiment according to the present invention.

FIG. 15 illustrates an embodiment in which an endless ink permeable belt is used in lieu of the ink permeable belt of FIG. 12.

Figure 16:
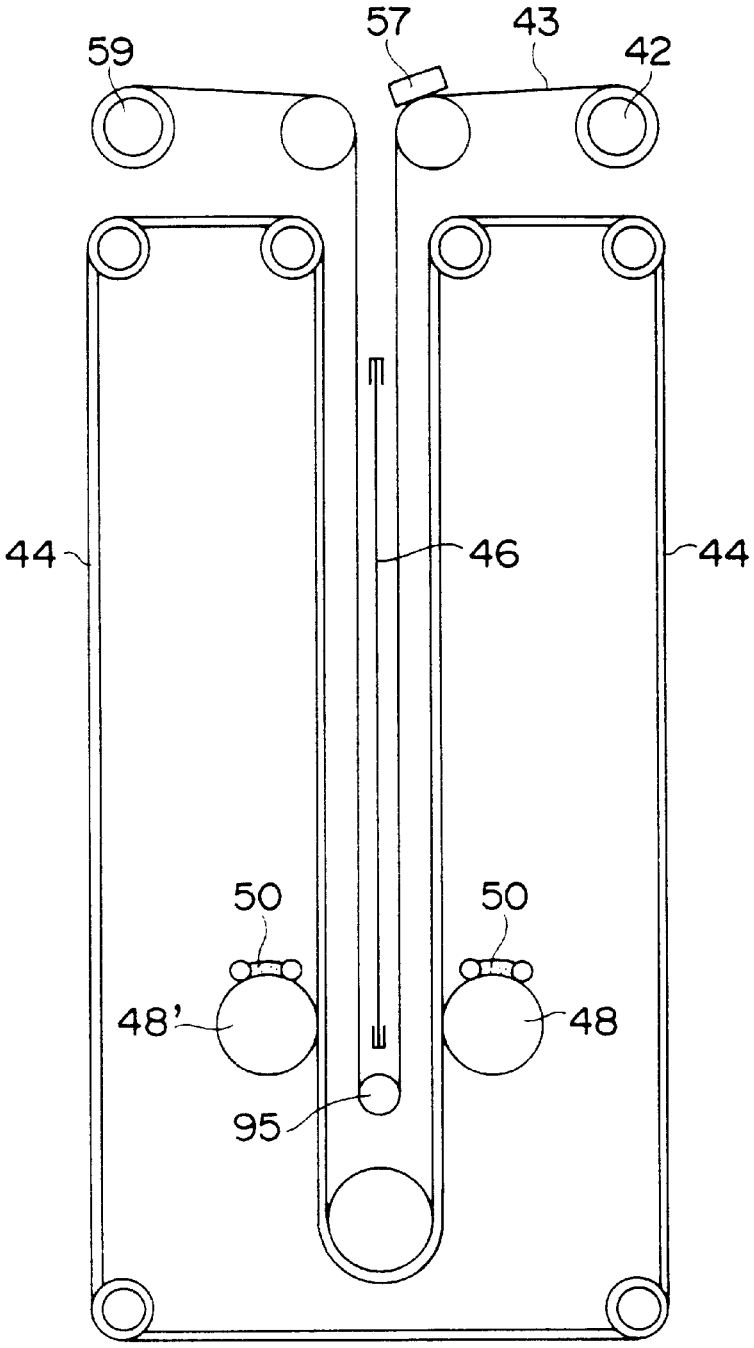
FIG. 16 is a schematic illustration of an essential part of a modified example of the third embodiment according to the present invention.

FIG. 16 illustrates an embodiment in which the endless ink permeable belt is formed into a U-shaped structure.

Figure 17:
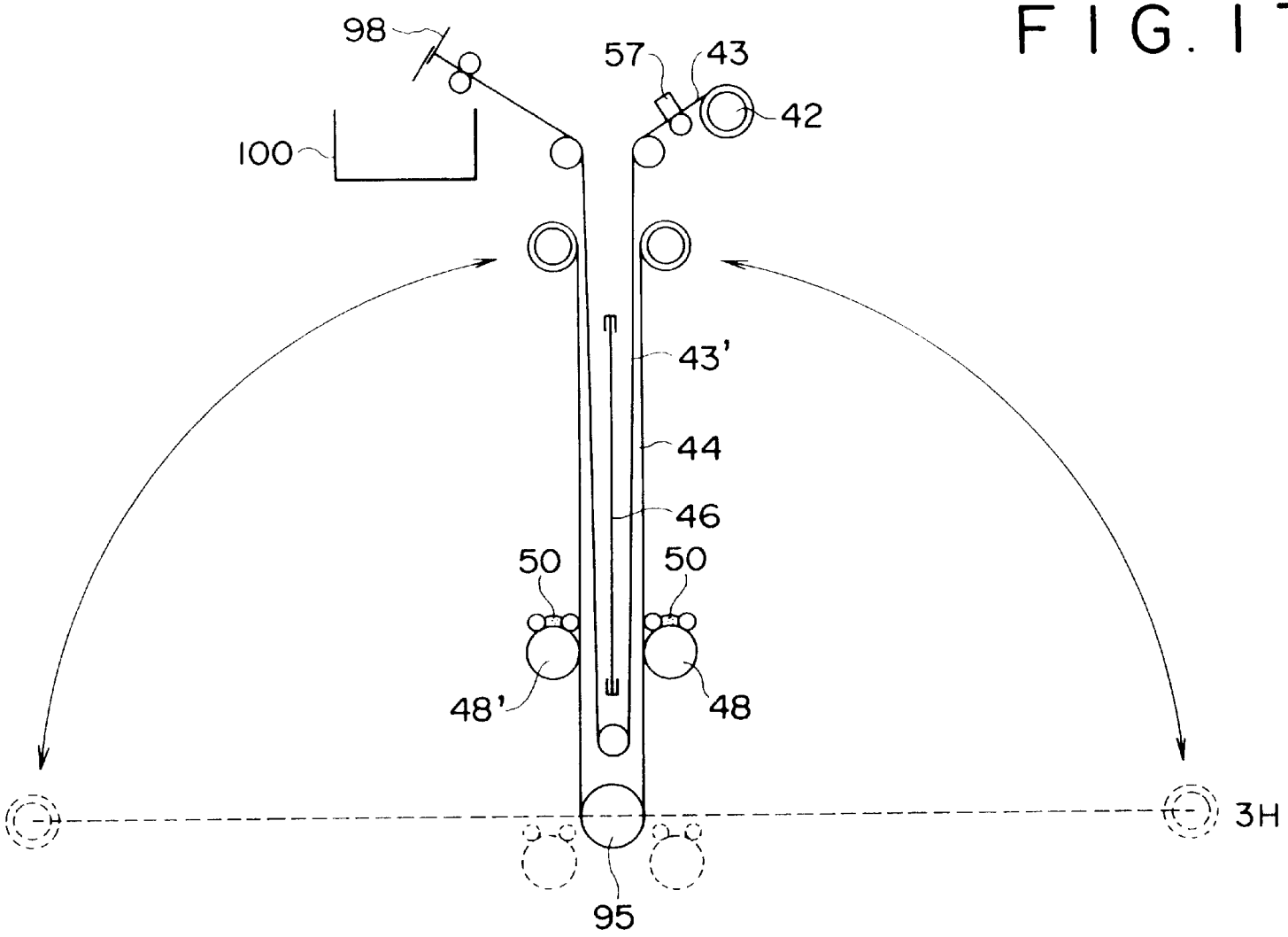
FIG. 17 is a schematic illustration of an essential part of a modified example of the third embodiment according to the present invention.
Figure 18:
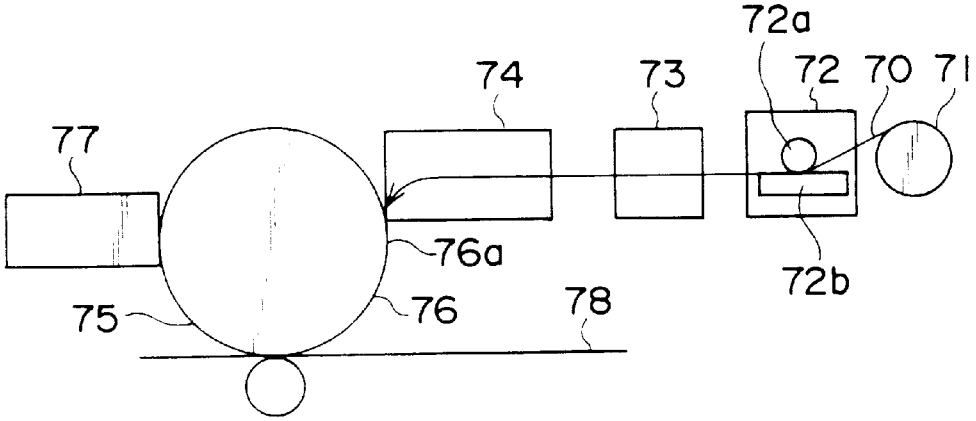
FIG. 18 PRIOR ART
FIG. 18 is a schematic view explanatory of a conventional stencil master printing device.
Figure 19:
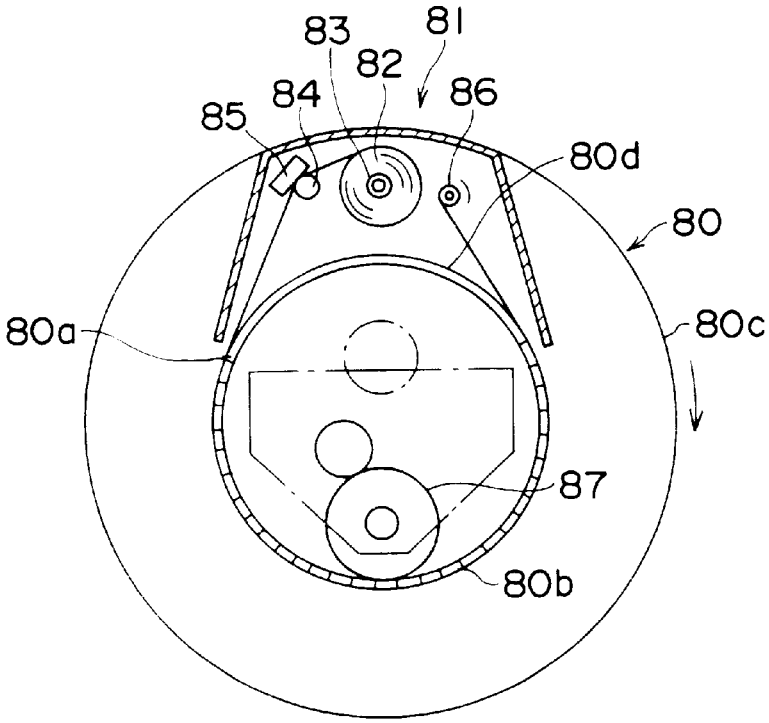
FIG. 19 PRIOR ART
FIG. 19 is a schematic cross-sectional view of a stencil master printing device disclosed in JP-A-H2-73987.
Figure 20:
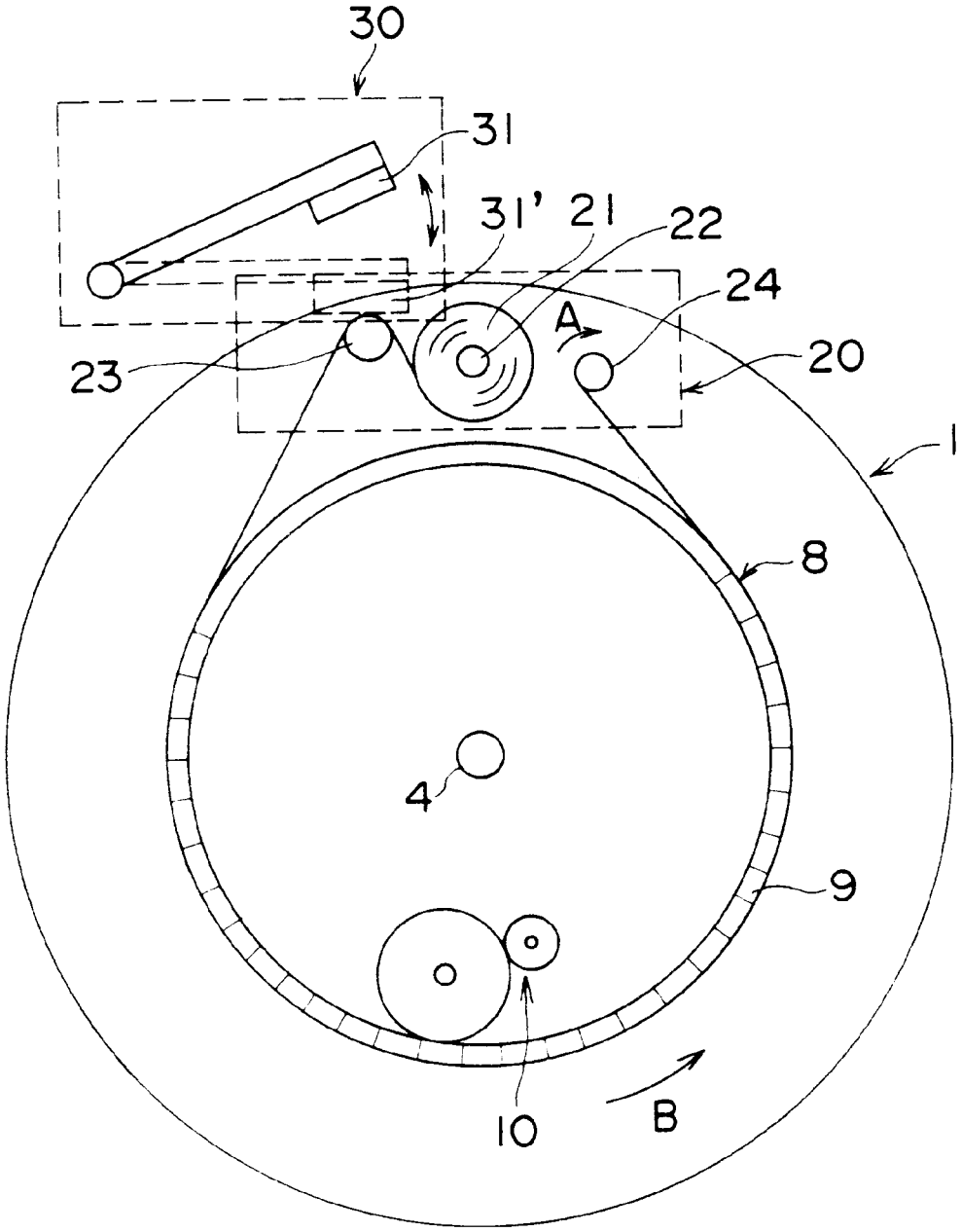
FIG. 20 PRIOR ART
FIG. 20 is a schematic cross-sectional view of a stencil master printing device disclosed in JP-A-H6-247024.

FIG. 17 illustrates an embodiment in which an elongated ink permeable belt is formed into a U-shaped structure and in which rollers are made moveable rightward and leftward to the position 3H so as to facilitate a treatment at the time of jamming of the stencil master and printing paper. The stencil master after completion of the printing is cut with a master cutter 98 and is collected in a master receiving box 100.

The stencil printing methods and apparatuses shown in FIGS. 12–17 permit the printing without cutting the stencil master. Therefore, a stencil master having a low stiffness such as a single film can be transferred. Since neither the portion corresponding to a plate cylinder nor the stencil master is rotated during the printing, mechanical adverse influence on the stencil master by offsetting of the center of gravity does not occur. Further, prints having little ghost can be obtained. Additionally, an enlargement of the printing apparatus, generation of noise and complication of the apparatus can be minimized.

In the present invention, a master is sandwiched between an ink permeable belt and a printing paper. These elements do not displace during the printing. The stencil master is mainly subjected to only to a force acting in the thickness direction. Thus, it is possible to print a number of prints. A substrate for retaining strengths is not necessarily required. Further, by replacing ink feeding means inclusive of an ink roller and the ink permeable belt with those of another color, multi-color printing can be effectively adopted.

According to the present invention, since it is not necessary to cut a stencil master into a sheet, to attach the sheet to a plate and to remove the sheet therefrom, as in the conventional technique, it is possible to use a thin stencil master. Further, it is possible to handle (transfer, attachment to the plate and detachment therefrom) a stencil master made only a single thermoplastic resin film. Moreover, no complicated master attachment and detachment mechanisms are required. Further more, the weight of the plate cylinder unit which performs rotation and rocking movement is not large. It is not difficult to install wiring for thermal head. No contamination of paper powder occurs. Yet, the degree of movement for avoiding collision with a pressing belt for the pressure contact with the thermoplastic resin film is smaller than that of the conventional apparatus (the apparatus can be made compact).

Also, printing method and apparatus permitting application to multi-color printing can be provided.

Further, there is provided an apparatus capable of performing simultaneous, both sides printing while minimizing enlargement of the printer, generation of noise and complication of the apparatus.

What is claimed is:

1. A stencil printing method comprising:

providing an ink permeable belt mounted with a tension;

disposing a stencil master on one side of said ink permeable belt to form a printing section, said stencil master extending between a feeding part and a drawing part;

bringing a printing paper into contact with said stencil master; and displacing ink feeding means which is maintained in contact with said ink permeable belt, so that the ink penetrates through said ink permeable belt and said stencil master and exudes therefrom to form a print on said printing paper.

2. A stencil printing method as recited in claim 1, further comprising providing said stencil master made of substantially a single film comprising a thermoplastic resin film on which a treatment for preventing sticking to a thermal head and/or a treatment for preventing charging of static electricity has been carried out.

3. A stencil printing method comprising:

providing an ink permeable belt mounted with a tension so as to have opposing surfaces;

disposing a stencil master which has been fed in an elongated state and which is provided with thermal perforations, without being cut, on both opposing surfaces of said ink permeable belt to form a pair of printing sections;

introducing printing paper to said printing sections; and displacing a pair of ink feeding means while pressing said ink permeable belt, said stencil master and said printing paper, so that the ink penetrates through said ink permeable belt and said stencil master and exudes therefrom to form prints on both sides of said printing paper.

4. A stencil printing method as recited in claim 3, further comprising providing said stencil master made of substantially a single film comprising a thermoplastic resin film on which a treatment for preventing sticking to a thermal head and/or a treatment for preventing charging of static electricity has been carried out.

5. A stencil printing apparatus comprising:

an ink permeable belt mounted with a tension;

a stencil master disposed on a first side of said ink permeable belt to form a printing section, said stencil master extending between a feeding part and a drawing part;

ink feeding means disposed on a second side of said ink permeable belt; and a perforation section for forming perforations in a thermoplastic resin film to form said stencil master, wherein during printing, said ink permeable belt is maintained substantially stationary whereas said ink feeding means is displaced while being maintained in contact with said ink permeable belt, so that the ink penetrates through said ink permeable belt and said stencil master and exudes therefrom.

6. A stencil printing apparatus as recited in claim 5, wherein said ink permeable belt has a number of sections corresponding to a number of ink colors and wherein said ink feeding means are provided in the same number as that of said ink colors.

7. A stencil printing apparatus as recited in claim 5, wherein said ink feeding means is moveable in a direction substantially normal to the direction along which said stencil master is fed.

8. A stencil printing apparatus as recited in claim 5, wherein said ink permeable belt is a rotatable circular belt.

9. A stencil printing apparatus as recited in claim 5, wherein said ink permeable belt is a wound belt.

10. A stencil printing apparatus as recited in claim 5, wherein a part or entirety of said ink permeable belt is made of sintered body of a metal.

11. A stencil printing apparatus as recited in claim 5, wherein at least a surface of said ink permeable belt which is in contact with said stencil master is made of a fibrous structural body having a diameter of 0.5–20 $\mu$m, and wherein the air permeability in the thickness direction of said ink permeable belt is in the range of 3.0–250 $cm^3/cm^2$.second.

12. A stencil printing apparatus as recited in claim 5, wherein said ink permeable belt has a laminate structure having at least two layers which are moveable relative to each other.

13. A stencil printing apparatus comprising:

an ink permeable belt mounted with a tension so as to have opposing surfaces;

a stencil master which is fed in an elongated state and which is provided with thermal perforations, without being cut, on both opposing surfaces of said ink permeable belt to form a pair of printing sections; a printing paper being disposed to said pair of printing sections; and a pair of ink feeding devices which are displaced while pressing said ink permeable belt, said stencil master and said printing paper, so that the ink penetrates through said ink permeable belt and said stencil master and exudes therefrom to form prints on both sides of said printing paper.

14. A stencil printing apparatus comprising:

an ink permeable belt mounted with a tension;

a stencil master disposed on a first side of said ink permeable belt to form a printing section, said stencil master extending between a feeding part and a drawing part;

an ink feeding device disposed on a second side of said ink permeable belt; and a perforation section for forming perforations in a thermoplastic resin film to form said stencil master, wherein during printing, said ink permeable belt is maintained substantially stationary and wherein said ink feeding device is displaced while being maintained in contact with said ink permeable belt, so that the ink penetrates through said ink permeable belt and said stencil master and exudes therefrom.

* * * * *